US011098566B2

(12) United States Patent
Lu et al.

(10) Patent No.: US 11,098,566 B2
(45) Date of Patent: Aug. 24, 2021

(54) PULSE HYDRAULIC FRACTURING TOOL AND METHOD FOR COILED TUBING DRAGGING WITH BOTTOM PACKER

(71) Applicant: CHONGQING INSTITUTE OF GEOLOGY AND MINERAL RESOURCES, Chongqing (CN)

(72) Inventors: Zhaohui Lu, Chongqing (CN); Pei He, Chongqing (CN)

(73) Assignee: CHONGQING INSTITUTE OF GEOLOGY AND MINERAL RESOURCES, Chongqing (CN)

( * ) Notice: Subject to any disclaimer, the term of this patent is extended or adjusted under 35 U.S.C. 154(b) by 51 days.

(21) Appl. No.: 16/631,842

(22) PCT Filed: Apr. 18, 2019

(86) PCT No.: PCT/CN2019/083185

§ 371 (c)(1),
(2) Date: Jan. 17, 2020

(87) PCT Pub. No.: WO2020/103393

PCT Pub. Date: May 28, 2020

(65) Prior Publication Data

US 2021/0222535 A1 Jul. 22, 2021

(30) Foreign Application Priority Data

Nov. 21, 2018 (CN) ..... 201811389155.3

(51) Int. Cl.

| | |
|---|---|
| ***E21B 43/26*** | (2006.01) |
| ***E21B 47/06*** | (2012.01) |
| ***E21B 33/12*** | (2006.01) |

(52) U.S. Cl.
CPC ..... *E21B 43/26* (2013.01); *E21B 47/06* (2013.01); *E21B 33/12* (2013.01)

(58) Field of Classification Search
CPC ..... E21B 43/26; E21B 47/06; E21B 43/2607; E21B 33/12
See application file for complete search history.

(56) References Cited

FOREIGN PATENT DOCUMENTS

| | | |
|---|---|---|
| CN | 102031931 | 4/2011 |
| CN | 102953719 | 3/2013 |

(Continued)

OTHER PUBLICATIONS

"International Search Report (Form PCT/ISA/210) of PCT/CN2019/083185," dated Aug. 21, 2019, pp. 1-5.

*Primary Examiner* — James G Sayre
(74) *Attorney, Agent, or Firm* — JCIP Global Inc.

(57) ABSTRACT

A pulse hydraulic fracturing tool of coiled tubing dragging with bottom packer includes a pulse frequency regulating device and liquid jetting device connected to each other. The pulse frequency regulating device has a rotor, a rotating member, a fixed member and a stator. An eccentric setting is arranged between the stator and the rotor. A part of a first fluid provided by the coiled tubing flows into the jet cavity through the channel in the rotor, and drives the rotor to rotate with another part of the first fluid, such that a first passing region is formed between the rotating member and the fixed member in a predetermined pulse frequency. The another part of the first fluid flows into the jet cavity through the first passing region. The nozzle ejects two parts of the first fluid mixed in the jet cavity out.

14 Claims, 5 Drawing Sheets

(56) References Cited

FOREIGN PATENT DOCUMENTS

| | | | | | |
|---|---|---|---|---|---|
| CN | 104847326 | | | 8/2015 | |
| CN | 105443085 | | | 3/2016 | |
| CN | 109184655 | | | 1/2019 | |
| CN | 111980879 | A | * | 11/2020 | ..... E21B 43/26 |
| EP | 2730740 | | | 5/2014 | |
| RU | 2147336 | | | 4/2000 | |
| WO | WO-2016028886 | A1 | * | 2/2016 | ..... E21B 43/263 |

* cited by examiner

PULSE HYDRAULIC FRACTURING TOOL AND METHOD FOR COILED TUBING DRAGGING WITH BOTTOM PACKER

CROSS-REFERENCE TO RELATED APPLICATION

This application is a 371 of international application of PCT application serial no. PCT/CN2019/083185, filed on Apr. 18, 2019, which claims priority to and the benefit of China Patent Application No. 201811389155.3, filed on Nov. 21, 2018. The entirety of each of the above-mentioned patent applications is hereby incorporated by reference herein and made a part of this specification.

BACKGROUND

Technical Field

The present invention relates, in general, to hydraulic fracturing of oil and gas. It is a pulse hydraulic fracturing tool and method of coiled tubing dragging with bottom packer.

Description of Related Art

With the development and utilization of unconventional gas resources and marginal oil and gas reservoirs, the requirements for equipment and technology are constantly rising. Especially in order to achieve commercial development of unconventional gas resources such as shale gas, hydraulic fracturing technology is one of the indispensable means. It uses fracturing vehicles pump high-pressure liquid into reservoir in casing in conventional hydraulic fracturing, which can achieve the purpose of reservoir reformation through repeated operations. However, conventional hydraulic fracturing technology also faces problems such as large scale and large energy consumption. Hydraulic jet fracturing (HJF) is one of the hydraulic fracturing. Hydraulic jetting tools are added to solve the problem of multiple string up-and-down. Compared with conventional hydraulic fracturing, it is more energy saving and accurate. But as the limited service life and energy form of underground hydraulic injection tools, multiple string removal is often required for multi-section reservoir reformation. Pulse hydraulic fracturing is a new technology which is energy saving and efficient. It has all the advantages of hydraulic jet fracturing, as well as more energy saving and efficient characteristics. It is more likely to crack rocks, forming a complex fracture network. It has been widely recognized in the industry, but its development is limited by the level of equipment technology.

At present, there are few tools for underground pulse hydraulic energy generation in the market. Existing tools cannot meet the needs of hydraulic fracturing with large displacement and large liquid volume, and there are problems such as complicated tool structure, poor adaptability of underground operation environment, short service life, and easy damage of nozzle after sand addition. A single operation needs to run string more times. It increases time and cost.

SUMMARY

It is a general object of the present invention to provide pulse hydraulic fracturing tool and method of coiled tubing dragging with bottom packer. It can generate pulse hydraulic fracturing energy to do reservoir stimulation more efficiently.

The technical solution is as follows.

The prevent invention provides a pulse hydraulic fracturing tool including a pulse frequency regulator and a liquid jetting device connected to each other. The pulse frequency regulating device has a rotor having a channel therein for driving passage of a part of a first fluid provided by a coiled tubing, a rotating member, a fixed member and a stator. The stator and the rotor are arranged in an eccentric setting. The liquid jetting device has a jet cavity communicating the channel inside the rotor and the gap that is formed between the stator and the rotor, and a nozzle communicating the jet cavity. The part of the first fluid provided by the coiled tubing flows into the jet cavity through the channel in the rotor. The rotor drives the rotating member to rotate relative to the fixed member. A first passing region is formed between the rotating member and the fixed member in a predetermined pulse frequency for the another part of the first fluid provided by the coiled tubing to intermittently pass therethrough. The another part of the first fluid flows into the jet cavity through the first passing region and the gap between stator and rotor. The part of the first fluid and the another part of the first fluid are mixed in the jet cavity and form pulse hydraulic fracturing energy that ejects out through the nozzle. The rotor is driven to rotate by the part of the first fluid entering the channel and the another part of the first fluid entering the gap.

Preferably, the fixed member is provided with a second passing region for the second fluid to pass therethrough. The second fluid passing through the second passing region with the pulse hydraulic energy ejected out through the nozzle cooperatively form hydraulic energy for cracking a rock together.

Preferably, a length of the fixed member in the radial direction of the rotor is greater than that of the rotating member in a radial direction of the rotor.

Preferably, the rotating member and fixed member is composed of a plurality of first sector plates located in a same plane. A first spacer region is provided between adjacent two of the first sector plates. The fixed member is composed of a plurality of second sector plates located in a same plane, and a second spacer region is provided between adjacent two of the second sector plates. The fixed member is composed of a plurality of second sector plates located in a same plane, a second spacer region is provided between adjacent two of the second sector plates. The second passing region is a part of the second spacer region that is not covered by a vertical projection of the rotating member, when the rotating member is completely and perpendicularly projected on the second spacer region.

Preferably, a length of the first spacer region between the adjacent two first sector plates, in an arc direction, is less than or greater than a length of the second sector plate, in the arc direction.

Preferably, the rotating member is a first circular plate sleeved on the rotor, and the first circular plate is provided with a first hole. the fixed member is a second circular plate sleeved on the rotor, a second hole is arranged on a part of the second circular plate that is covered by a vertical projection of the first circular plate, a third hole is arranged on a part of the second circular plate that is not covered by the vertical projection of the first circular plate. When a vertical projection part of the first hole is located in the second hole, the first passing region is an overlapping region formed by a vertical projection of the first hole in the second hole and the second hole, and the second passing region is a region enclosed by the third hole.

Preferably, the rotor and the stator are matched by eccentric spiral clearance.

Preferably, the fixed member is located at the outer periphery of the rotor through a ring. The ring is provided with a pass-through groove for sliding insertion of the fixed member in a radial direction of the rotor, when the another part of the first fluid which provided by the coiled tubing enters between the ring and the rotor, the fixed member moves outward in the radial direction of the rotor under an action of the another part of the first fluid to form a gap with the rotor.

Preferably, the nozzle is in plurality, and the plurality of nozzles are spirally arranged on an outer side of the jet cavity.

Preferably, an end surface of the liquid jetting device facing the stator has a holding chamber. The injection device is threadedly connected with the stator.

Preferably, the predetermined pulse hydraulic frequency is determined by formula:

$$f = \frac{Q}{12EDT},$$

wherein f is the predetermined pulse frequency, Q is total flow pumped through the coiled tubing, E is eccentric distance between the stator and the rotor, D is a diameter of the rotor, and T is a lead of the rotor.

Preferably, a pressure drop between the rotor (6) and the stator (7) is determined by formula:

$$\Delta P = \frac{2a\rho Q^2 L}{R_e^b A^2 (d_h - d_s)},$$

wherein ΔP is the pressure drop, Q is total flow pumped through the coiled tubing (15), L is a length of the rotor, ρ is density of the first fluid, a is a first coefficient, b is a second coefficient, A is an average diameter of the coiled tubing, $R_e$ is Reynolds Number, $d_h$ an outer diameter of the stator, and $d_s$ is an outer diameter of the rotor. The first coefficient is determined by formula:

$$a = \frac{\log^{n_e} + 3.93}{50},$$

wherein $n_e$ is annular flow pattern index. The second coefficient is determined by formula:

$$b = \frac{1.75 - \log^{n_e}}{7},$$

wherein $n_e$ is annular flow pattern index.

Preferably, pulse injection pressure of the pulse hydraulic energy ejected by the nozzle (9) is determined by formula:

$$P_e = \frac{Q^2 \eta^4}{n^2 d^2 0.658^2},$$

wherein $P_e$ is the pulse injection pressure, Q is total flow pumped through the coiled tubing, η is nozzle efficiency coefficient, n is nozzle number, and d is nozzle diameter.

The present invention also provides a pulse hydraulic fracturing method of coiled tubing dragging with bottom packer, including following steps. Mounting a pulse hydraulic fracturing tool connected to a coiled tubing into a casing filled with a second fluid, and after mounting, placing the pulse hydraulic fracturing tool in the well at a target depth. Pumping the first fluid into the coiled tubing through a first driving device, wherein a part of the first fluid flows into a jet cavity of a liquid jetting device through a channel of a rotor, and the rotor drives a rotating member to rotate relative to a fixed member, such that a first passing region is formed between the rotating member and the fixed member in a predetermined pulse frequency for another part of the first fluid provided by the coiled tubing to intermittently pass therethrough. The another part of the first fluid flows into the jet cavity of the liquid jetting device through a gap between the rotor and a stator. Via the nozzle of the liquid jetting device, ejecting pulse hydraulic energy, formed by the part of the first fluid and the another part of the first fluid being mixed in the jet cavity, on a wall of the casing, such that the casing is formed with a perforating hole. After the perforating hole is formed, pumping the first fluid into the coiled tubing through the first driving device, and pumping the second fluid into the casing through a second driving device. The second fluid enters a fitting chamber between the casing and the stator through a second passing region on the fixed member. The second fluid entering the fitting chamber is combined with the pulse hydraulic energy ejected from the nozzle to form hydraulic energy, which travels through the ejecting hole on the casing to fracture a rock corresponding to the target depth.

The advantages of the present invention are as follows.

1. The pulse hydraulic fracturing tool has the advantages of simple structure, good stability and displacement (is able to achieve conventional segmented bridging plug displacement level), and strong adaptability in the well. This solves the problems of short life and limited displacement of the conventional hydraulic fracturing tool.

2. Parameters of pulse hydraulic energy generated in the well such as pulse frequency and injection pressure are controllable, so as to reach the purpose of precisely controlling the parameters of the pulse, and solve the problem that the control of the conventional pulse hydraulic fracturing parameters are completely limited by the tool under the well or the ground apparatus.

3. The nozzle has long service life. The sealing way of the pulse hydraulic fracturing tool is simply. The tool is able to perform sealing or unsealing at any time. The bottom sealing has simple structure, and is easy to access. The method associated with the tool solves the problems that the nozzle of the conventional pulse hydraulic fracturing tool is easy to be damaged by sand, and the method reduces the times of rising and lowering the pipe. This saves hydraulic fracturing time and further reduces the cost.

DESCRIPTION OF THE EMBODIMENTS

Figure 1:
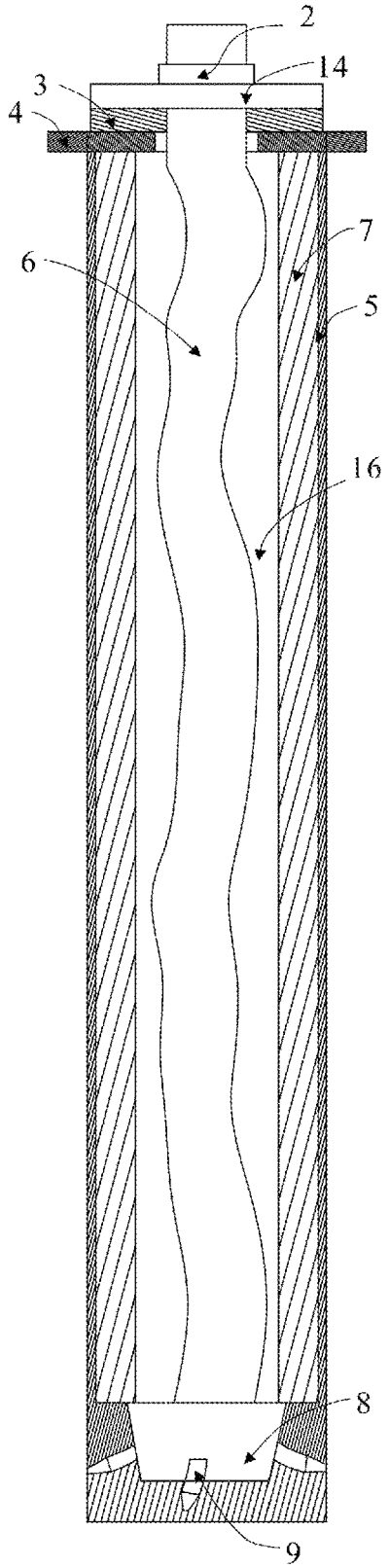
FIG. 1 is a simplified view of the present invention tool.

Referring to FIG. 1 to FIG. 8 a preferred embodiment of the invention is shown in detail. The invention provides a pulse hydraulic fracturing tool and method for coiled tubing dragging with bottom packer. The pulse hydraulic fracturing tool includes a pulse frequency regulator and liquid jetting device connected to each other. The pulse frequency regulating device has a rotor 6, a rotating member 3, a fixed member 4 and a stator 7. The rotor 6 has an internal channel 11 which a part of the first fluid in a coiled tubing 15 pass therethrough. The rotating member 3 and fixed member 4 are mounted on the rotor 6. The rotating member 3 rotates with the rotor 6. There are an eccentric setting and a gap 16 between the stator 7 and the rotor 6. The rotor 6 is driven by the first fluid. The liquid jetting device has a jet cavity 8 communicating the channel 11 inside the rotor 6 and the gap 16, and a nozzle 9 communicating the jet cavity 8. The part of the first fluid which the coiled tubing 15 provides flows into the jet cavity 8 through the channel 11 of the rotor 6, and drives the rotor 6 to rotate. The rotor 6 drives the rotating member 3 to rotate relative to the fixed member 4, such that a first passing region is formed between the rotating member 3 and the fixed member 4 in a predetermined pulse frequency. Another part of the first fluid provided by the coiled tubing 15 pass the first passing region intermittently. The another part of the first fluid passing through the first passing region flows into the jet cavity 8 via the gap 16 between the rotor 6 and the stator 7. Two parts (i.e., the part and the another part) of the first fluid are mixed in the jet cavity 8 and form pulse hydraulic energy. The nozzle 9 ejects out the pulse hydraulic energy. The rotor 6 is driven to rotate by the part of the first fluid entering the channel 11 and the another part of the first fluid entering the gap 16.

The first fluid is pumped into the coiled tubing 15 through a first driving device (one fracturing truck or first fracturing truck group formed by a plurality of fracturing trucks). A second fluid is pumped into the casing 17 through a second driving device. In general, the first driving device is fracturing trucks, the second driving device (second fracturing truck group) includes fracturing trucks and sand mixing trucks, etc. The first driving device provides the first fluid with low displacement and high pump pressure for the coiled tubing 15. The second driving device provides the second fluid with high displacement and moderate pump pressure for the casing 17.

The rotor 6 is driven to rotate by the part of the first fluid entering the channel 11 and the another part of the first fluid entering the gap 16. The first part of the first fluid pumped into the coiled tubing 15 co-rotates with the rotor 6 after flowing into the rotor 6, and enters the jet cavity 8 of the liquid jetting device. During rotation of the rotor 6, the rotor 6 drives the rotating member 3 to rotate together. When the rotating member 3 rotates with respect to the fixed member 4, a flow rate of the first fluid in the first passing region continues to change dynamically. Specifically, the flow rate is manifested as the reciprocating change from high to small and from small to high. As such, the first fluid arriving the jet cavity 8 is composed of the part of the first fluid which enters through the rotor 6 and the another part of the first fluid which enters through the gap between the rotor 6 and the stator 7. The part of the first fluid entering through the rotor 6 has stable entering flow rate, and another part of the first fluid has pulsed entering flow rate. Two parts of the first fluid are mixed together in the jet cavity 8, and then the pulse hydraulic energy ejected through the nozzle 9 is in pulse type.

Figure 3:
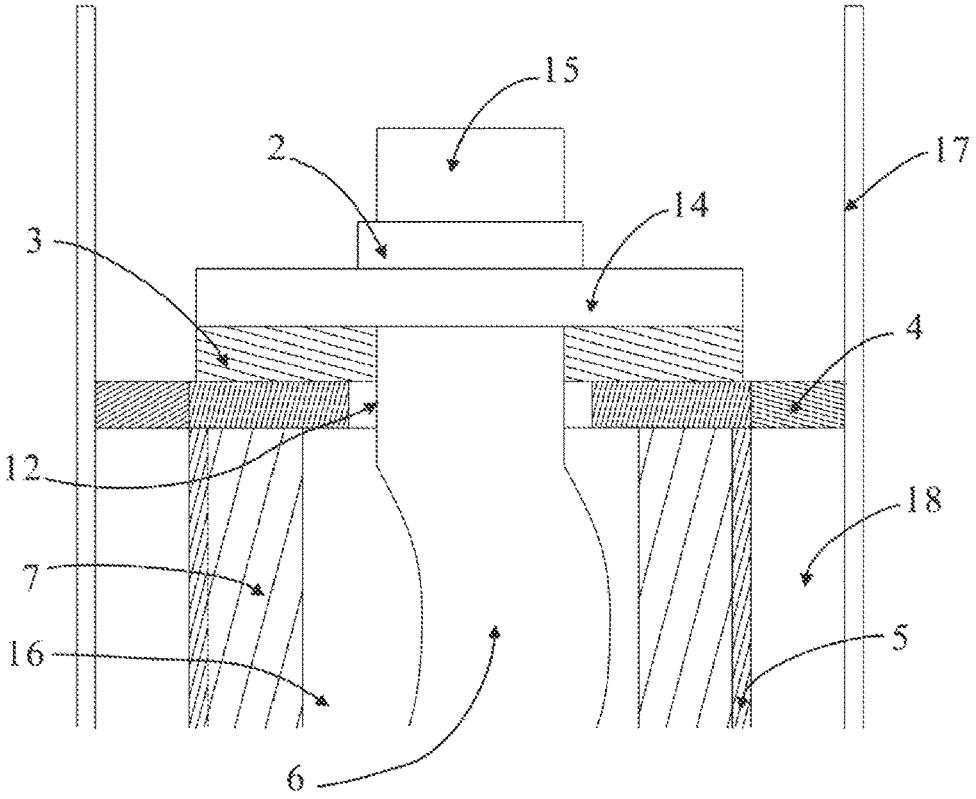
FIG. 3 is a schematic view of enlargement at A of FIG. 2.

As illustrated in FIG. 3, in order to make the first fluid to be divided into two parts before entering the tool, a dividing structure 14 and a rotary joint 2 are connected at a head portion of the rotor 6. The dividing structure 14 is connected between rotary joint 2 and the rotor 6. The rotary joint 2 is rotatably connected to the coiled tubing 15, so that the coiled tubing 15 does not rotate with the rotor 6. The rotary joint 2 has a channel for the first fluid provided by the coiled tubing 15 to pass therethrough. The dividing structure 14 has a chamber in communication with a channel inside the coiled tubing 15. The chamber is also in communication with the channel 11 of the rotor 6 and the first passing region formed between the rotating member 3 and the fixed member 4. As such, the first fluid enters the chamber of the dividing structure 14 through the channel of the rotary joint 2, and is divided at an outlet of the chamber. The part of the first fluid flows into the channel 11 of rotor 6, and another part of the first fluid flows into the first passing region between the rotating member 3 and the fixed member 4.

When operation of rock fracturing, the tool should be installed into the casing 17 filled with the second fluid. In addition, it is necessary to use the nozzle 9 to eject the pulse hydraulic energy on a wall of the casing 17, so as to form a perforating hole on the casing 17. In order to form the perforating hole on the casing 17 at a specific location, an nozzle exit 10 of the nozzle 9 shall be located at a target location on the casing 17 in this application. The nozzle exit 10 is disposed on an outer surface of the liquid jetting device.

In this application, in consideration that the flow rate of the first fluid pumped through the coiled tubing 15 cannot meet the requirements of rock fracturing, the present application further provides the second fluid which enters a fitting chamber 18 between casing 17 and the stator 7, and increases pulse pressure peak. The pulse hydraulic energy generated by pulse injection is coordinated with the second fluid in the fitting chamber 18 to generate the hydraulic energy needed for rock fracturing, and to increase pulse pressure peak. It achieves the purpose of pulse pressurization, further enhance the pulse effect and meet the high pressure requirements of perforation. In order for the second fluid to enter the fitting chamber 18, in the application, the fixed member 4 is provided with a second passing region for the second fluid to pass therethrough. The second fluid passing through the second passing region and the pulse hydraulic energy ejected out through the nozzle 9 cooperatively form hydraulic energy for cracking a rock together. Besides, for cracking the target rock, the perforating hole formed on the casing 17 should be right aligned with the target rock. As such, after the formation of the perforating hole on the target location of the casing 17, the hydraulic energy generated by the first fluid cooperating with the second fluid can crack the target rock.

In order for the hydraulic fracturing tool of the present application to generate pulse hydraulic energy and combine the generated pulse hydraulic energy with the second fluid to form hydraulic energy for rock cracking, special Settings are required for the structure of the fixed member 4 and the rotating member 3. In this application, two specific implementation schemes of the fixed member 4 and the rotating member 3 are provided. A length of the fixed member 4 in a radial direction of the rotor 6 is greater than that of the rotating member 3 in the radial direction of the rotor 6.

Figure 4:
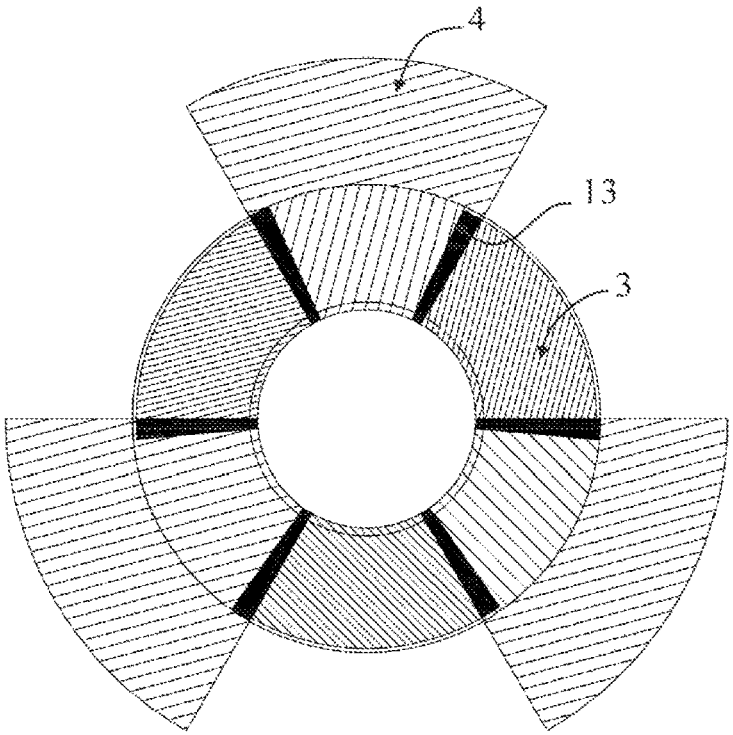
FIG. 4 is a schematic matching view of the rotating member and fixed member.
Figure 9:
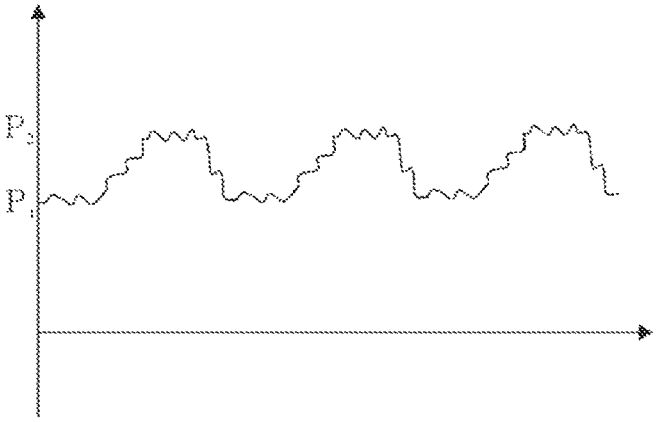
FIG. 9 is a schematic view of pulse waveform generated by present invention tool.

In the first implementation scheme, as illustrated in FIG. 4, the rotating member 3 comprises a plurality of first sector plates in a same plane. A first spacer region is provided between adjacent two of the first sector plates. The fixed member 4 also comprises a plurality of second sector plates in a same plane. A second spacer region is provided between adjacent two of the second sector plates. The first passing region is an overlapped area formed by a vertical projection of the first spacer region on the second spacer region and the second spacer region when the rotating member 3 is partially or completely vertically projected on the fixed member 4. The second passing region is a part of the second space region that is not covered by a vertical projection of the rotating member 3, when the rotating member 3 is completely and perpendicularly projected on the second space region. Specifically, the rotating member 3 and fixed member 4 are multiple sector plates. A length of the first spacer region between the adjacent two of the first sector plates, in an arc direction, is smaller than that of the second sector plate, in the arc direction, such that when the first sector plate is projected onto the second sector plate, there is always an overlapping region 13 between the first sector plate and the second sector plate. Alternatively, the length of the first spacer region between the adjacent two of the first sector plates, in the arc direction, is greater than the length of the second sector plate, in the arc direction, such that when the second sector plate is projected onto the first sector plate, there is always the overlapping region 13 between the projection of the first sector plate and the second sector plate. The occurrence of the overlapping region 13 can make the tool to form the pulse hydraulic energy that ejects on the target rock through the perforating hole, as the waveform shown in FIG. 9. In addition, when the tool in the first implementation scheme is installed in the casing 17, the seal is formed between an outer surface of the second sector plate and the casing wall.

In the second implementation scheme, the rotating member 3 is the first circular plate sleeved on the rotor 6. The first circular plate is provided with a first hole. The fixed member 4 is a second circular plate sleeved on the rotor 6. A second hole is arranged on a part of the second circular plate covered by a vertical projection of the first circular plate. A third hole is arranged on a part of the second circular plate that is not covered by the vertical projection of the first circular plate. When a vertical projection part of the first hole is located in the second hole, the first passing region is an overlapping region formed by a vertical projection of the first hole in the second hole, and the second passing region is a region enclosed by the third hole. The first circular plate and the second circular plate are regular circular plate. When the tool in the second implementation scheme is installed in the casing 17, the seal is formed between the outer surface of the second circular plate and the casing wall.

In the above two schemes, no matter how the rotating member 3 rotates, the second passing region will not be blocked. This can make the second fluid keep in constant state.

Figure 5:
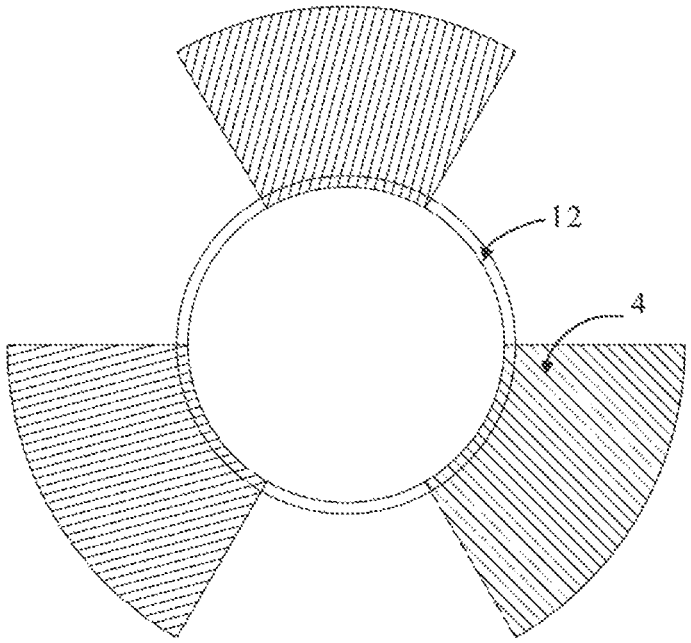
FIG. 5 is a schematic matching view of the fixed member and ring.
Figure 6:
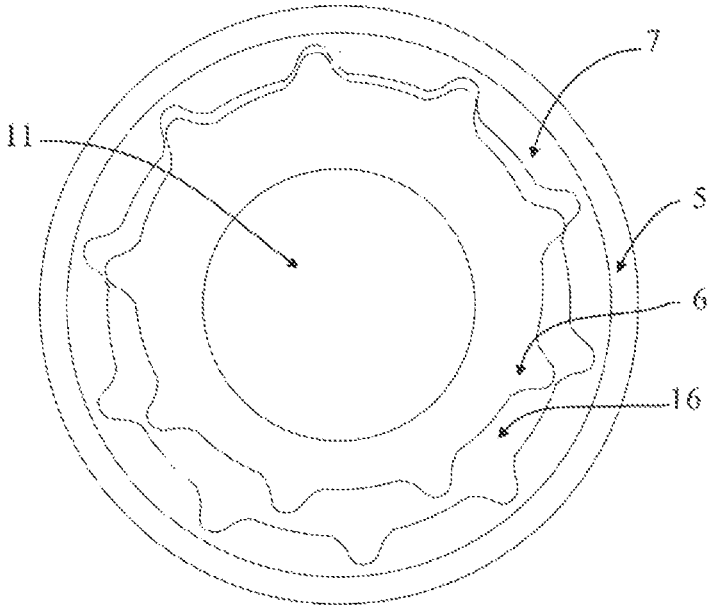
FIG. 6 is a schematic matching view of the rotor, stator and liquid jetting device.
Figure 7:
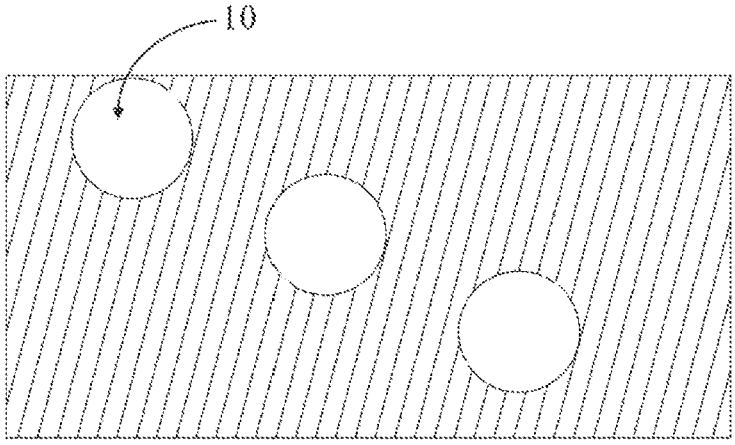
FIG. 7 is a simplified view of the first layout of nozzles in liquid jetting device.
Figure 8:
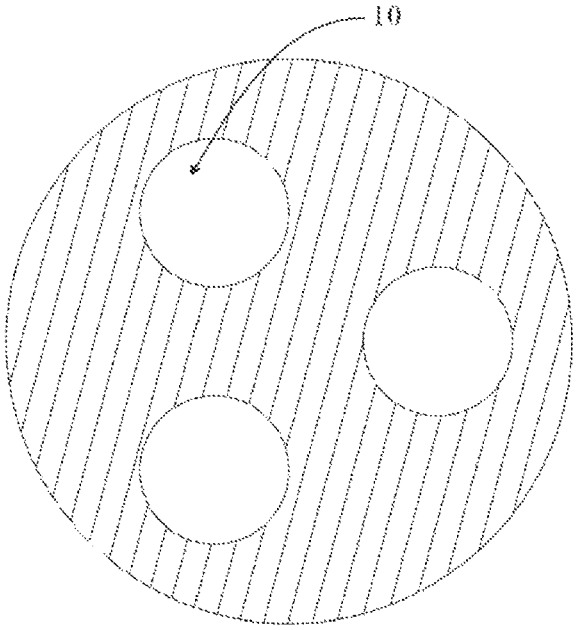
FIG. 8 is a simplified view of the second layout of nozzles in liquid jetting device.

In order that the fixed member 4 can be installed in the casing 17 to form the seal between the casing wall and not rotate synchronously with rotor 6, in this application, as shown in FIG. 5, the fixed member 4 is located at an outer periphery of the rotor 6 through the ring 12. The ring 12 is provided with a pass-through groove for sliding insertion of the fixed member 4 in a radial direction of the rotor 6. When the another part of the first fluid which provided by the coiled tubing 15 enters between the ring 12 and the rotor 6, the fixed member 4 moves outward in the radial direction of the rotor 6 under an action of the another part of the first fluid to form a gap with the rotor 6. Specifically, the ring 12 is mounted on the rotor 6 in a clearance fit way. After the another part of the first fluid flows out through the outlet of the dividing structure 14, it then enters the gap between the ring 12 and the rotor 6. Under the action of this part of the first fluid, the fixed member 4 moves outward in the radial direction of the rotor 6. At the same time, the fixed part 4 is in tight contact with an inner wall of the casing 17 to achieve sealing effect under the action of hydraulic pressure difference.

Figure 2:
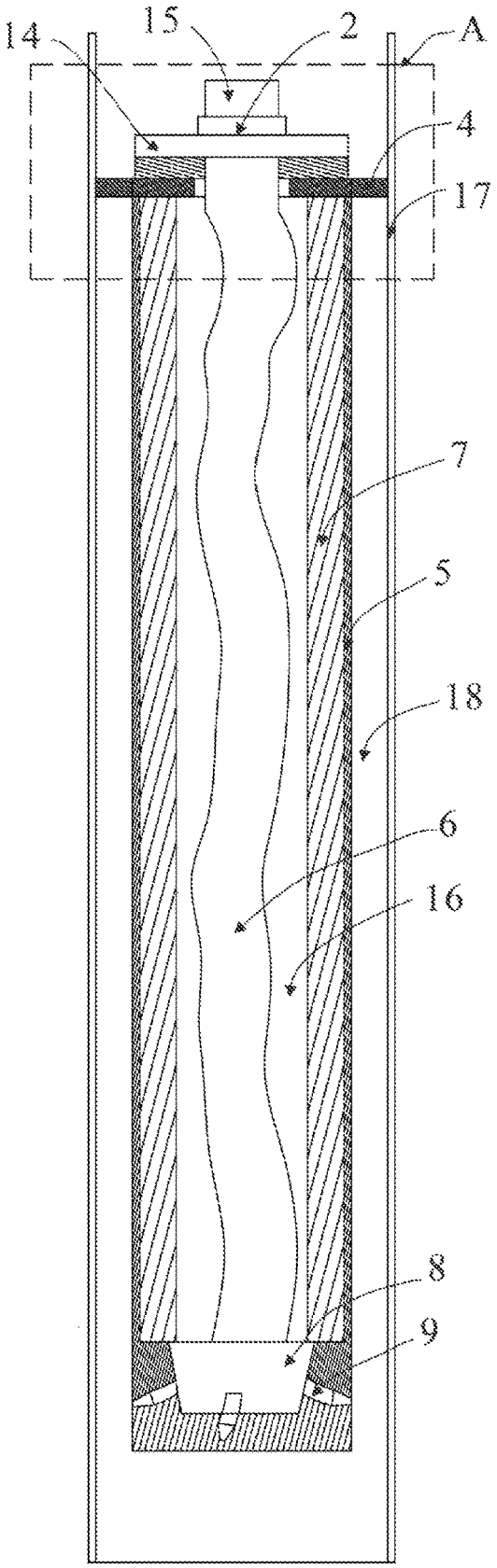
FIG. 2 is a simplified view of the matching of casing and coiled tubing respectively for the present invention tool.

As shown in FIG. 1 to FIG. 3, the rotor 6 in this application is a pipe fitting with multiple bending parts. The rotor 6 and the stator 7 are matched by eccentric spiral clearance. The gap 16 formed between the rotor 6 and the stator 7 has different widths at different positions. The part of the first fluid provided by the coiled tubing 15 is pressurized and pulsed into the jet cavity 8.

The rotor 6 and the stator 7 are allocated by the certain section contour ratio. According to different pulse frequency and rotation torque of the rotating member 3, there are five types of main contour ratio which are 1:2, 3:4, 5:6, 7:8 and 9:10. The lengths of the rotor 6 and the stator 7 are determined by the rotation torque of the rotating member 3. The principle of minimization is adopted to reduce the tool length and the pressure drop between the rotor 6 and the stator 7. The rotor 6 adopts hollow structure to reduce friction and increase displacement of the pulse hydraulic fracturing tool.

In this application, the liquid jetting device has a holding chamber toward disposed at an end surface of the liquid jetting device. The end surface of the liquid jetting device faces toward the stator 7. The stator 7 is disposed in the holding chamber. The injection device is threadedly connected with the stator 7. The jet cavity 8 is a self-excited oscillation chamber with pressurization effect. As shown in FIG. 1 to FIG. 3, the liquid jetting device has a screw shell 5 having a length that matches the length of the stator 7. The holding chamber is arranged on the screw shell 5. The stator 7 is inserted into the holding chamber of screw shell 5, and is in thread connection to the holding chamber, so as to form a seal. The liquid jetting device is connected to the stator 7 by a screw connection. Therefore, it is possible to choose and design different injection devices with different nozzles according to the needs.

The first fluid passing through the rotor 6 and the stator 7 flows to the nozzle cavity 8, and forms high-pressure jet flow by the action of the nozzle 9. It can increase the pulse pressure, enhance the pulse effect and meet the high pressure requirements for perforating.

In order to improve the sealing performance between the fixed member 4 and casing 17, an outer surface of the fixed member 4 away from the rotor 6 is a curved surface or an arc surface, which fits well with an inner surface of the casing 17. According to different tool models, the sealing pressure between the fixed member 4 and the casing 17 is divided into seven grades, which are 20 MPa, 40 MPa, 60 MPa, 70 MPa, 80 MPa, 100 MPa and 120 MPa.

In addition, in order to install the tool in the casing 17, the rotating member 3 can freely rotate, and the length of the rotating member 3 in the radial direction of the rotor 6 is less than that of the fixed member 4 in the radial direction of the rotor 6. A gap with an interval of 2-4 mm is formed between the casing 17 and an outer surface of the rotating member 3, which enables the rotating member 3 to rotate freely relative to the casing 17. Meanwhile, due to the viscosity of the second fluid, the second fluid fills the gap between the casing 17 and the rotating member 3 for lubrication and sealing.

For the tools in this application, the pulse frequency regulator and the liquid jetting device are made of alloy steel. Alloy steel is resistant to wear and corrosion.

As shown in FIGS. 1, 2, 3, 7 and 8, in the present application, the nozzle 9 is arranged in spiral state, which is divided into five types, 30°, 60°, 90°, 120° and 180°. The spiral distance between each nozzle 9 can be adjusted according to the perforating requirements of the casing 17. In addition, the number and spiral angle of the nozzle 9 can be adjusted as required to meet the different requirements of the injecting hole of the casing 17. The high-pressure liquid jetting device needed for the injecting hole is replaceable as needed during fracturing.

The predetermined pulse frequency can be adjusted and obtained through the formula:

$$f = \frac{Q}{12EDT},$$

wherein f is pulse frequency, Q is total flow pumped through the coiled tubing 15, E is eccentric distance between the stator 7 and the rotor 6, D is diameter of the rotor, and T is a lead of the rotor 6.

The pressure drop between rotor 6 and the stator 7 is determined by the following formula:

$$\Delta P = \frac{2a\rho Q^2 L}{R_e^b A^2 (d_h - d_s)},$$

wherein ΔP is the pressure drop, Q is the total flow pumped through the coiled tubing 15, L is the length of the rotor, ρ is density of the first fluid, a is first coefficient, b is second coefficient, A is average diameter of the coiled tubing 15, $R_e$ is Reynolds Number, $d_h$ is an outer diameter of the stator 7, and $d_s$ is an outer diameter of the rotor 6.

The first coefficient is determined by the following formula:

$$a = \frac{\log^{n_e} + 3.93}{50},$$

wherein $n_e$ is the annular flow pattern index.

The second coefficient is determined by the following formula:

$$b = \frac{1.75 - \log^{n_e}}{7},$$

wherein $n_e$ is the annular flow pattern index.

The pulse injection pressure of the pulse hydraulic energy ejected by nozzle 9 is determined by the following formula:

$$P_e = \frac{Q^2 \eta^4}{n^2 d^2 0.658^2},$$

wherein $P_e$ is the pulse injection pressure, Q is the total flow pumped through the coiled tubing 15, η is nozzle efficiency coefficient, n is nozzle number, and d is nozzle diameter.

The tool can generate pulse hydraulic energy with controllable key parameters such as pulse frequency, pulse injection pressure and displacement, which has simple structure, good stability, and long service life. The sealing of the tool is good and the sealing way is simple. The generated pulse hydraulic energy is more likely to crack the rock, forming a complex fracture network.

Furthermore, the invention also provides a pulse hydraulic fracturing method of coiled tubing dragging with bottom packer. The method includes following steps. Mounting the pulse hydraulic fracturing tool connected to the coiled tubing 15 into the casing filled with the second fluid, and placing the pulse hydraulic fracturing tool in a well at a target depth.

The first fluid is pumped into the coiled tubing 15 by the first driving device. The part of the first fluid flows into the jet cavity 8 of the liquid jetting device through the channel 11 of the rotor 6. The rotor 6 drives the rotating member 3 to rotate with respect to fixed member 4, such that the first passing region is formed between the rotating member 3 and the fixed member 4 in a predetermined pulse frequency for the another part of the coiled tubing 15 to intermittently pass therethrough. The another part of the first fluid flows into the jet cavity 8 of the liquid jetting device through the gap 16 between the rotor 6 and the stator 7. Via the nozzle 9, the first fluid with pulse hydraulic energy is formed by the part of the first fluid and the another part of the first fluid being mixed in the jet cavity 8. The nozzle 9 ejects the pulse hydraulic energy on the wall of the casing 17, and the casing 17 is formed with the perforating hole. After the perforating hole is formed, the first fluid is pumped into the coiled tubing 15 through the first driving device, and the second fluid is pumped into the casing 17 through the second driving device. The second fluid enters the fitting chamber 18 between the casing 17 and the stator 7 through the second passing region on the fixed member 4. The second fluid entering the fitting chamber 18 is combined with the pulse hydraulic energy ejected from the nozzle 9 to form the hydraulic energy. The resulting hydraulic energy travels through the perforating hole on the casing 17 to fracture the rock at the target depth.

Specifically, the method mainly includes the following steps.

Step 1, wellbore preparation. It scrapes the well with a scraper at the end of cementing, and then washes the well with well washing fluid or clear water.

Step 2, fracturing pipeline connection. According to the type of the casing and the size of formation fracture pressure, one to three fracturing trucks should be connected with the coiled tubing 15. They can provide the first fluid with low displacement and high pump pressure. Multiple fracturing trucks and sand mixers are connected with the coiled tubing 15 and annulus of the casing 17. They can provide the second fluid with high and moderate pump pressure. The pipeline is connected with four-way connection of wellhead. The two sets of pipelines are independent of each other and merged into the same command. It is easy to operate and control.

Step 3, setting pulse hydraulic fracturing tool. Firstly, making the casing 17 be filled with the second fluid. Connecting the coiled tubing 15 with the connector of the pulse hydraulic fracturing tool. Placing the tool at the specified target depth of the well. Pumping pressure to the coiled tubing 15 with a first driving device (first fracturing truck group) until to the rated seal pressure of the pulse hydraulic fracturing tool, and then stabilizing the pressure and keeping the tool in a sealing state.

Step 4, perforation. A balance pressure is injected between the coiled tubing 15 and the casing 17 though four-way connection. The first fluid is pumped into the coiled tubing 15 through the first driving device with low displacement and high pump pressure. Perforating is completed by jetting.

Step 5, fracturing in the first stage. After the perforation, the second fracturing truck group is started to pump the second fluid with moderate pumping pressure and high displacement between the coiled tubing 15 and casing 17. At the same time, continue to pump the first fluid into the coiled tubing 15 with high pumping pressure and low displacement. According to the reservoir situation, the pump pressure of the first fluid can be adjusted in real time to achieve the purpose of adjusting the pulse pressure value. Proppant and related materials are added via four-way connection and the second fracturing truck group. Proppant should be added at a lower rate than conventional hydraulic fracturing to prevent the rotating member 3 from plugging. The pulse hydraulic fracturing of this stage is completed after the scheduled pumping procedure is completed.

Step 6, unsealing the pulse hydraulic fracturing tool. After the end of the first fracturing stage, fracturing truck group is decompressed on the ground and the pulse hydraulic fracturing tool is unsealed.

Step 7, fracturing in the second stage. Lifting the pulse hydraulic fracturing tool to the designated location of the second stage fracturing (if the pulse hydraulic fracturing tool needs to be replaced, lifting all the string to the ground for replacement), setting the tool and perforation. The second fracturing stage is performed according to the first fracturing stage.

Step 8, fracturing the remaining stages. Repeat the step 7 to fracture the remaining stages, and pay attention to observe the construction pump pressure and detect whether the pulse hydraulic fracturing tool is damaged.

Step 9, complete all fracturing stages, unseal the pulse hydraulic fracturing tool and upper body string, and finish fracturing.

The abovementioned tool and the method of the present invention can be applied in the field of petroleum gas reservoir hydraulic fracturing transformation, reservoir deblocking, or reservoir production increase. It can generate pulse energy with controllable key parameters such as frequency, pressure and displacement under the well. The tool has simple structure, good stability, long service life, simple sealing structure, which solves the problem that the nozzle of the conventional hydraulic fracturing tool is easy to be damaged. At the same time, the formed pulse hydraulic energy is more likely to crack the rock and forms complex net.

Specifically, the advantages of the present invention are as follows.

1. The pulse hydraulic fracturing tool has the advantages of simple structure, good stability and displacement (is able to achieve conventional segmented bridging plug displacement level), and strong adaptability in the well. This solves the problems of short life and limited displacement of the conventional hydraulic fracturing tool.

2. Parameters of pulse hydraulic energy generated in the well such as pulse frequency and injection pressure are controllable, so as to reach the purpose of precisely controlling the parameters of the pulse, and solve the problem that the control of the conventional pulse hydraulic fracturing parameters are completely limited by the tool under the well or the ground apparatus.

3. The nozzle has long service life. The sealing way of the pulse hydraulic fracturing tool is simply. The tool is able to perform sealing or unsealing at any time. The bottom sealing has simple structure, and is easy to access. The method associated with the tool solves the problems that the nozzle of the conventional pulse hydraulic fracturing tool is easy to be damaged by sand, and the method reduces the times of rising and lowering the pipe. This saves hydraulic fracturing time and further reduces the cost.

Although the present invention has been described in considerable detail with reference to certain preferred configuration thereof, other versions are possible. Therefore, the spirit and scope of the appended claims should not be limited to their preferred versions contained therein.

What is claimed is:

1. A pulse hydraulic fracturing tool, the pulse hydraulic fracturing tool comprising a pulse frequency regulating device and a liquid jetting device connected to each other, the pulse frequency regulating device including:

a rotor having a channel thereinside, which is used to drive passage of a part of a first fluid provided by a coiled tubing;

a rotating member arranged on an outer periphery of the rotor and co-rotating with the rotor;

a fixed member arranged on the outer periphery of the rotor and fixed to the rotor, and the rotor rotating relative to the fixed member; and a stator arranged on the outer periphery of the rotor, and the rotor rotating relative to the stator; wherein the stator and the rotor are arranged in an eccentric setting, and a gap is provided between the stator and the rotor, the liquid jetting device including:

a jet cavity communicating the channel inside the rotor and the gap that is formed between the stator and the rotor; and a nozzle communicating the jet cavity, wherein, the part of the first fluid provided by the coiled tubing flows into the jet cavity through the channel in the rotor, the rotor drives the rotating member to rotate relative to the fixed member, a first passing region is formed between the rotating member and the fixed member in a predetermined pulse frequency, and another part of the first fluid provided by the coiled tubing intermittently passes through the first passing region, the another part of the first fluid flows into the jet cavity through the first passing region and the gap between the rotor and the stator, the part of the first fluid and the another part of the first fluid are mixed in the jet cavity and form pulse hydraulic energy that ejects out through the nozzle, and the rotor is driven to rotate by the part of the first fluid entering the channel and the another part of the first fluid entering the gap.

2. The pulse hydraulic fracturing tool of claim 1, wherein the fixed member is provided with a second passing region for a second fluid to pass therethrough, the second fluid passing through the second passing region and the pulse hydraulic energy ejected out through the nozzle cooperatively form hydraulic energy for cracking a rock together.

3. The pulse hydraulic fracturing tool of claim 2, wherein a length of the fixed member in a radial direction of the rotor is greater than that of the rotating member in the radial direction of the rotor.

4. The pulse hydraulic fracturing tool of claim 3, wherein the rotating member is composed of a plurality of first sector plates located in a same plane, a first spacer region is provided between adjacent two of the first sector plates, the fixed member is composed of a plurality of second sector plates located in a same plane, a second spacer region is provided between adjacent two of the second sector plates, the first passing region is an overlapped area formed by a vertical projection of the first spacer region on the second spacer region and the second spacer region when the rotating member is partially or completely vertically projected on the fixed member, and the second passing region is a part of the second spacer region that is not covered by a vertical projection of the rotating member, when the rotating member is completely and perpendicularly projected on the second spacer region.

5. The pulse hydraulic fracturing tool of claim 4, wherein a length of the first spacer region between the adjacent two first sector plates, in an arc direction, is less than or greater than a length of the second sector plate, in the arc direction.

6. The pulse hydraulic fracturing tool of claim 3, wherein the rotating member is a first circular plate sleeved on the rotor, the first circular plate is provided with a first hole, the fixed member is a second circular plate sleeved on the rotor, a second hole is arranged on a part of the second circular plate that is covered by a vertical projection of the first circular plate, a third hole is arranged on a part of the second circular plate that is not covered by the vertical projection of the first circular plate, when a vertical projection part of the first hole is located in the second hole, the first passing region is an overlapping region formed by a vertical projection of the first hole in the second hole and the second hole, and the second passing region is a region enclosed by the third hole.

7. The pulse hydraulic fracturing tool of claim 1, wherein the rotor and the stator are matched by eccentric spiral clearance.

8. The pulse hydraulic fracturing tool of claim 1, wherein the fixed member is located at the outer periphery of the rotor through a ring, the ring is provided with a pass-through groove for sliding insertion of the fixed member in a radial direction of the rotor, when the another part of the first fluid which provided by the coiled tubing enters between the ring and the rotor, the fixed member moves outward in the radial direction of the rotor under an action of the another part of the first fluid to form a gap with the rotor.

9. The pulse hydraulic fracturing tool of claim 1, wherein the nozzle is in plurality, and the plurality of the nozzles are spirally arranged on an outer side of the jet cavity.

10. The pulse hydraulic fracturing tool of claim 1, wherein an end surface of the liquid jetting device facing the stator has a holding chamber, the stator is received in the holding chamber, and the injection device is threadedly connected with the stator.

11. The pulse hydraulic fracturing tool of claim 1, wherein the predetermined pulse frequency is obtained through formula:

$$f = \frac{Q}{12EDT},$$

Wherein f is the predetermined pulse frequency, Q is total flow pumped through the coiled tubing, E is eccentric distance between the stator and the rotor, D is a diameter of the rotor, and T is a lead of the rotor.

12. The pulse hydraulic fracturing tool of claim 1, wherein a pressure drop between the rotor and the stator is determined by formula:

$$\Delta P = \frac{2a\rho Q^2 L}{R_e^b A^2 (d_1 - d_s)},$$

wherein ΔP is the pressure drop, Q is total flow pumped through the coiled tubing, L is a length of the rotor, ρ is density of the first fluid, a is a first coefficient, b is a second coefficient, A is an average diameter of the coiled tubing, $R_e$ is Reynolds Number, $d_h$ an outer diameter of the stator, and $d_s$ is an outer diameter of the rotor, the first coefficient is determined by formula:

$$a = \frac{\log^{n_e} + 3.93}{50},$$

wherein $n_e$ is annular flow pattern index, and the second coefficient is determined by formula:

$$b = \frac{1.75 - \log^{n_e}}{7}.$$

13. The pulse hydraulic fracturing tool of claim 1, wherein pulse injection pressure of the pulse hydraulic energy ejected by the nozzle is determined by formula:

$$P_e = \frac{Q^2 \eta^4}{n^2 d^2 0.658^2},$$

wherein $P_e$ is the pulse injection pressure, Q is total flow pumped through the coiled tubing, η is nozzle efficiency coefficient, n is nozzle number, and d is nozzle diameter.

14. A pulse hydraulic fracturing method comprising:

mounting a pulse hydraulic fracturing tool connected to a coiled tubing into a casing filled with a second fluid, and after mounting, placing the pulse hydraulic fracturing tool in a well at a target depth;

pumping the first fluid into the coiled tubing, wherein a part of the first fluid flows into a jet cavity of a liquid jetting device through a channel of a rotor, the rotor drives a rotating member to rotate relative to a fixed member, such that a first passing region is formed between the rotating member and the fixed member in a predetermined pulse frequency, and another part of the first fluid provided by the coiled tubing intermittently passes through the first passing region, the another part of the first fluid flows into the jet cavity of the liquid jetting device through a gap between the rotor and a stator; via the nozzle of the liquid jetting device, ejecting pulse hydraulic energy, formed by the part of the first fluid and the another part of the first fluid being mixed in the jet cavity, on a wall of the casing, such that perforating hole is formed on the casing; and after perforating, pumping the first fluid into the coiled tubing, and pumping the second fluid into the casing, wherein the second fluid enters a fitting chamber between the casing and the stator through a second passing region on the fixed member, the second fluid entering the fitting chamber is combined with the pulse hydraulic energy ejected from the nozzle to form hydraulic energy, which travels through the perforating hole on the casing to fracture a rock corresponding to the target depth.

* * * * *